US005689766A

United States Patent [19]

Hollar et al.

[11] Patent Number: 5,689,766

[45] Date of Patent: Nov. 18, 1997

[54] APPARATUS FOR CONTROLLING AIR FLOW IN A PRINTING MACHINE

[75] Inventors: Thomas C. Hollar, Penfield; Karl B. Ayash, Webster, both of N.Y.

[73] Assignee: Xerox Corporation, Stamford, Conn.

[21] Appl. No.: 548,220

[22] Filed: Oct. 25, 1995

[51] Int. Cl.[6] ..... G03G 21/00; G03G 21/20

[52] U.S. Cl. ..... 399/92

[58] Field of Search ..... 399/92, 93, 94, 399/97, 98, 96, 99, 116

[56] References Cited

U.S. PATENT DOCUMENTS

| | | | |
|---|---|---|---|
| 4,169,673 | 10/1979 | Sato et al. | 399/92 X |
| 4,264,184 | 4/1981 | Nishikawa et al. | 399/93 |
| 5,081,496 | 1/1992 | Takeda | 399/92 |
| 5,128,720 | 7/1992 | Creveling | 399/92 |
| 5,185,629 | 2/1993 | Iino et al. | 399/93 |

FOREIGN PATENT DOCUMENTS

0629931A1 12/1994 European Pat. Off. .

*Primary Examiner*—Fred L. Braun

*Attorney, Agent, or Firm*—R. Zibelli; J. E. Beck; H. Fleischer

[57] ABSTRACT

An apparatus for maintaining an ambient condition about a marking module. The apparatus includes a substantially air impervious enclosure defining a chamber having the marking module disposed therein. An air flow source supplies air to the chamber, and sensors respond to the amount of air flow to control the air flowing from the air source.

16 Claims, 7 Drawing Sheets

APPARATUS FOR CONTROLLING AIR FLOW IN A PRINTING MACHINE

This invention relates generally to a pressurized marking module for electrophotographic printing. More specifically, the invention relates to controlling the range of air flow within the module to produce an even distribution of air.

In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern known as a latent image. The latent image is developed by contacting it with a dry or liquid developer material having a carrier and toner. The toner is attracted to the image areas and held thereon by the electrostatic charge on the photoreceptor surface. Thus, a toner image is produced in conformity with a light image of the original being reproduced. The toner image is transferred to a copy sheet, and the image affixed thereto to form a permanent record of the image to be reproduced. Subsequent to development, excess toner left on the photoreceptor is cleaned from its surface. The process is useful for light lens copying from an original document or for printing electronically generated or stored originals such as with a raster output scanner (ROS), where a charged surface may be imagewise discharged in a variety of ways.

The foregoing discussion generally describes a typical black and white or single color electrophotographic printing process. The approach utilized for multicolor electrophotographic printing is substantially identical. However, instead of forming a single latent image on the photoreceptor, multiple latent images corresponding to different color separations are sequentially recorded on the photoreceptor. Each single color latent image is developed with toner complimentary thereto. This process is repeated for each of the differently colored images with a respective toner of a complimentary color. Thereafter, each single color toner image is transferred to the copy sheet in superimposed registration with the prior toner image, creating a multi-layered toner image. This multi-layered toner image is permanently affixed to the copy sheet in a conventional manner to form a finished color copy.

Since electrophotographic printing is an electrostatic process, it is sensitive to temperature changes and particle contamination. Both can degrade image quality. For example, adverse changes in temperature can change the charge and discharge characteristics of the photoreceptor. In addition, the operation of the image writing systems and corona discharge devices are influenced by the buildup of airborne contaminates which may include toner particles, paper dust, or other forms of dust and dirt from the surrounding environment. The contaminates adhere to the component surfaces and in the case of optical components block light reflected from or transmitted through them. As likely as not, an uneven distribution of air flowing around critical marking components will cause hot spots created by component heat losses and toner disturbances caused by a flow of high velocity air.

Thus, it is advantageous to isolate the marking components from airborne contaminates and ambient temperature conditions. An enclosed, pressurized module allows for the control of heat and contaminates to a greater degree than open ambient air systems. The pressurized module makes possible the introduction of an air conditioned environment to enable the cooling of marking components which is critical to component life and toner performance.

The following disclosure may be relevant to various aspects of the present invention.

European Patent Publication No. 0 629 931 A1
Applicant: Xeikon NV
Published: December 21, 1993

The disclosure of the above-identified patent application may be briefly summarized as follows European Patent Publication No. 0 629 931 A1 discloses an electrophotographic printer capable of providing conditioned air at the image producing stations to reduce print quality defects. The image producing stations are housed in a cabinet having an air inlet manifold and an outlet manifold. Air is maintained at a substantially stable temperature and humidity level via a heat exchanger, humidifier, and a high pressure blower housed in a separate cabinet. The conditioned air is circulated from the air conditioning cabinet to the printer cabinet through a common inlet. Inside the printer cabinet, air is sucked away at outlets leading to the outlet manifold.

In accordance with one aspect of the invention, there is provided an apparatus for maintaining an ambient condition about a marking module. The apparatus includes a substantially air impervious enclosure defining a chamber having the marking module mounted therein. An air source, coupled to the enclosure, supplies air to the chamber. The air flow is sensed in the enclosure chamber to control the air flowing from the air source to the chamber.

In accordance with yet another aspect of the invention, there is provided a printing machine of the type having a printing module associated with non-printing modules. The printing machine includes a substantially air impervious enclosure defining a chamber having the printing module mounted therein. An air source, coupled to the enclosure, supplies air to the chamber. The air flow is sensed in the enclosure chamber to control the air flowing from the air source to the chamber.

Figure 1:
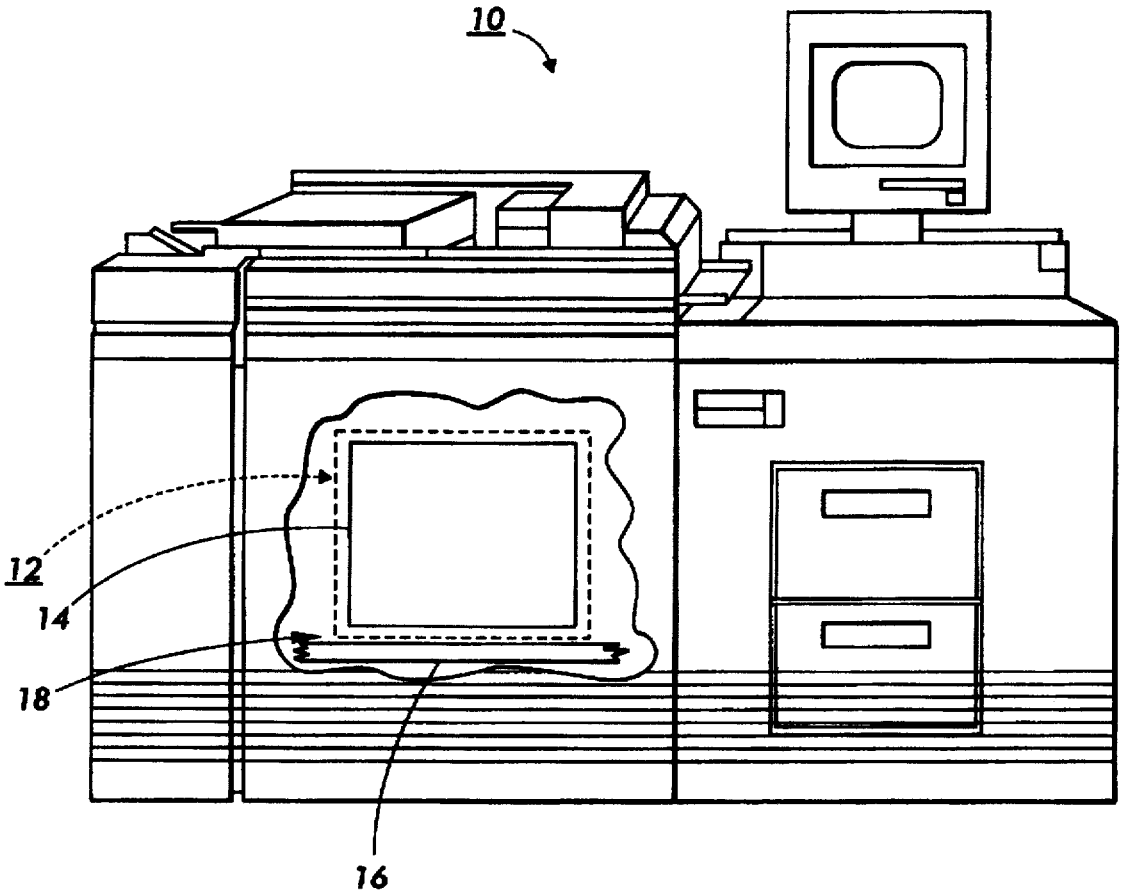
FIG. 1 is a perspective view of an illustrative printing machine incorporating the pressurized and temperature controlled marking module of the present invention therein.

While the present invention will hereinafter be described in connection with a preferred embodiment thereof, it will be understood that it is not intended to limit the invention to that embodiment. On the contrary, it is intended to cover all alternatives, modifications and equivalents that may be included within the spirit and scope of the invention as defined by the appended claims.

For a general understanding of the features of the present invention, reference is made to the drawings. In the drawings, like reference numerals have been used throughout to designate identical elements. It will become evident from the following discussion that the marking module air flow control of the present invention is equally well suited for use in a wide variety of printing machines and is not necessarily limited in its application to the particular embodiment depicted herein.

Turning now to FIG. 1,which illustrates one form of an electrophotographic printing machine, printing machine 10 of the present invention has a marking module 14. Marking module 14 includes the components (not shown) necessary to perform the xerographic steps of charging, imaging, exposure, development, transfer, fusing, and cleaning. The marking module 14 is in a pressurized semi air tight enclosure 12 located above sheet path 16.

Figure 2:
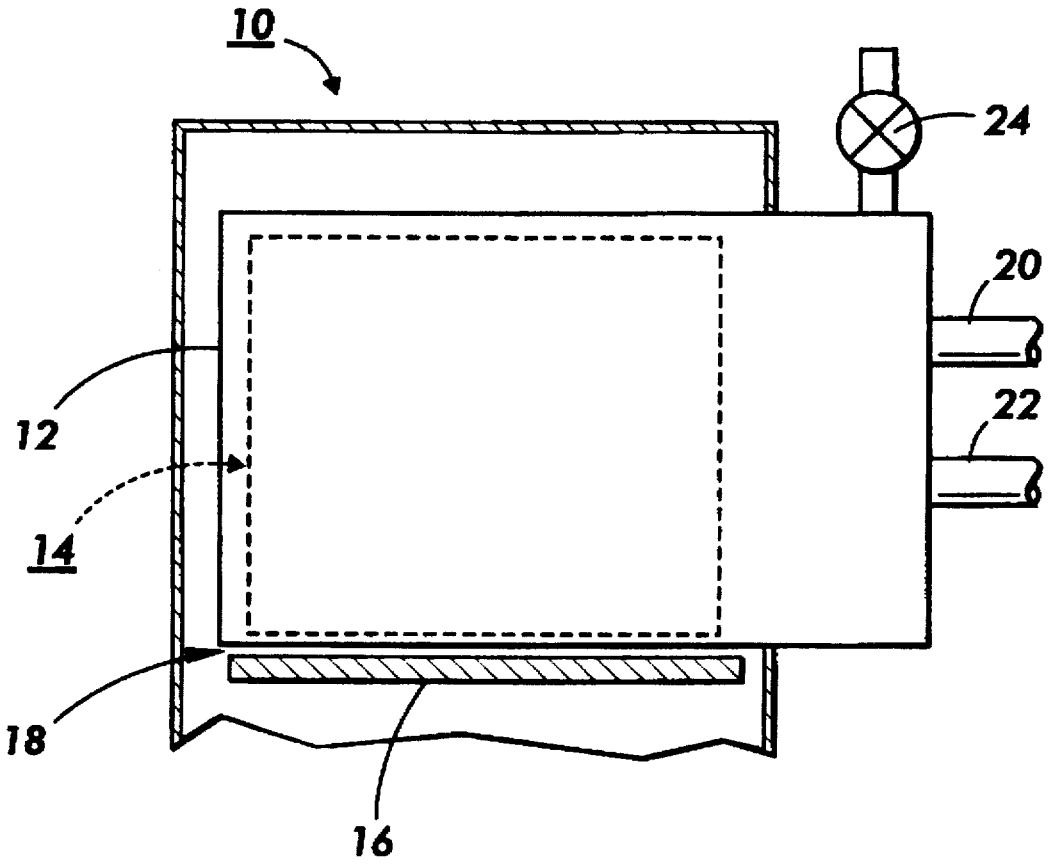
FIG. 2 is a side elevational view of the FIG. 1 printing machine.

Referring to FIG. 2, FIG. 2 depicts a side elevational view of the FIG. 1 printing machine. A remote air management unit (not shown) supplies air to enclosure 12 through an input conduit 20 and removes air from the enclosure via an output conduit 22. At machine start-up, a relief valve 24 automatically opens so as to prevent air from being drawn into enclosure 12 at gap 18.

The pressurized enclosure 12 shown in FIGS. 1 and 2 isolates marking module 14 from the rest of printing machine 10 so as to enable an accurate control of air flow around the components contained therein. The pressurized enclosure 12 eliminates dust, paper fiber, and machine contaminates from entering marking module 14. It also provides an air conditioned environment for cooling components to aid component life and toner performance.

Figure 3:
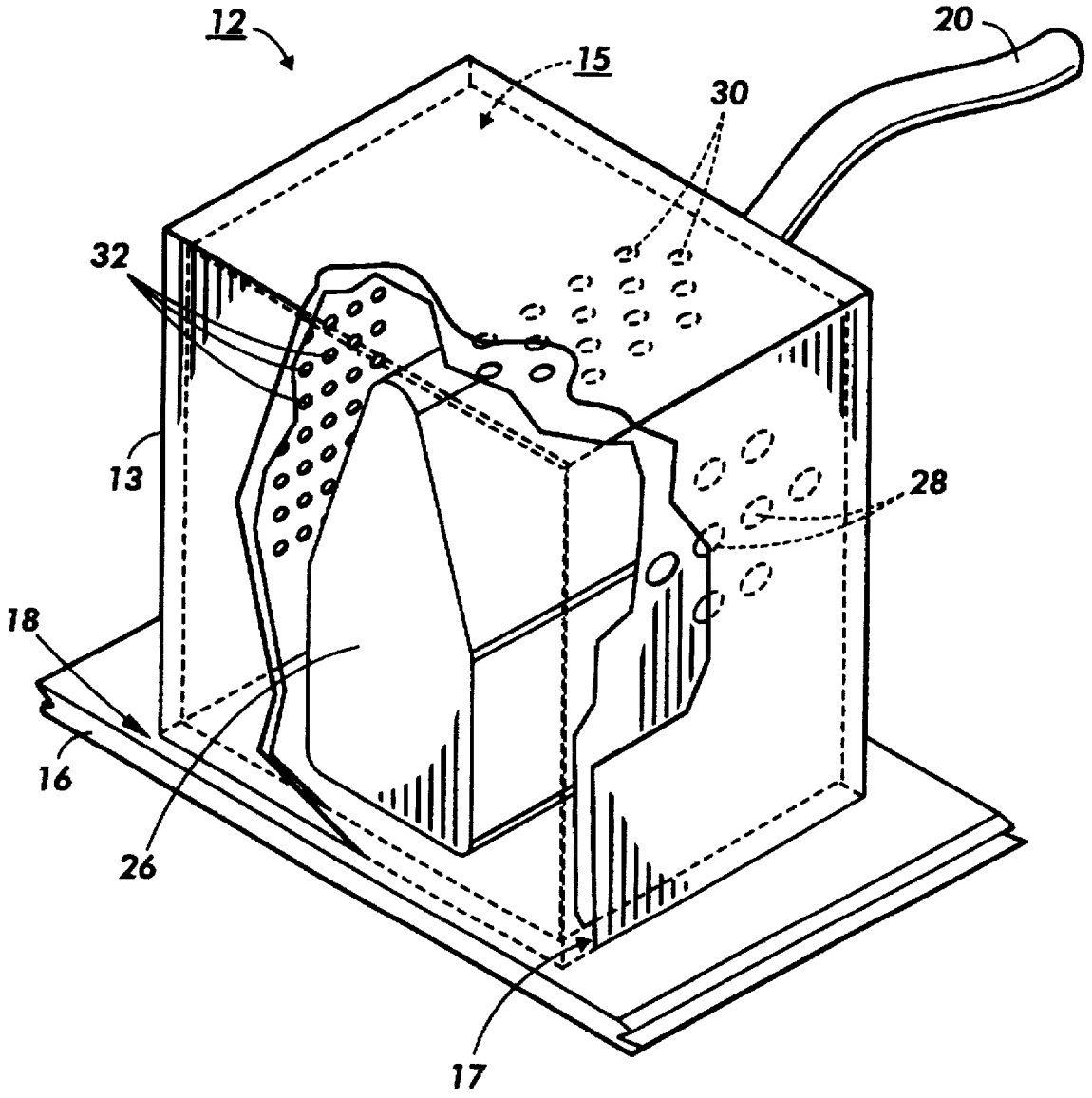
FIG. 3 is a schematic perspective view a of pressurized marking module having a double walled housing with the inner wall having apertures therein to control air flow.

Moving now to a more detailed description of the present invention, FIGS. 3 through 8 illustrate several embodiments thereof. In FIG. 3, a schematic view is shown of a pressurized semi air tight enclosure 12 having an outer wall 13 and an inner wall 15. The inner wall 15 surrounds a photoreceptor 26 having other components (not shown) positioned relative thereto. Air is introduced from a remote source (not shown) into a passage way 17 formed between walls 13 and 15 via conduit 20. A plurality of apertures 28, 30, and 32 located on inner wall 13 regulate the amount of air flow to critical locations around photoreceptor 26. The size shape and location of apertures 28, 30, and 32 are determined by the air flow requirements necessary to eliminate airborne contaminates and/or to cool integral components nearby.

Figure 4:
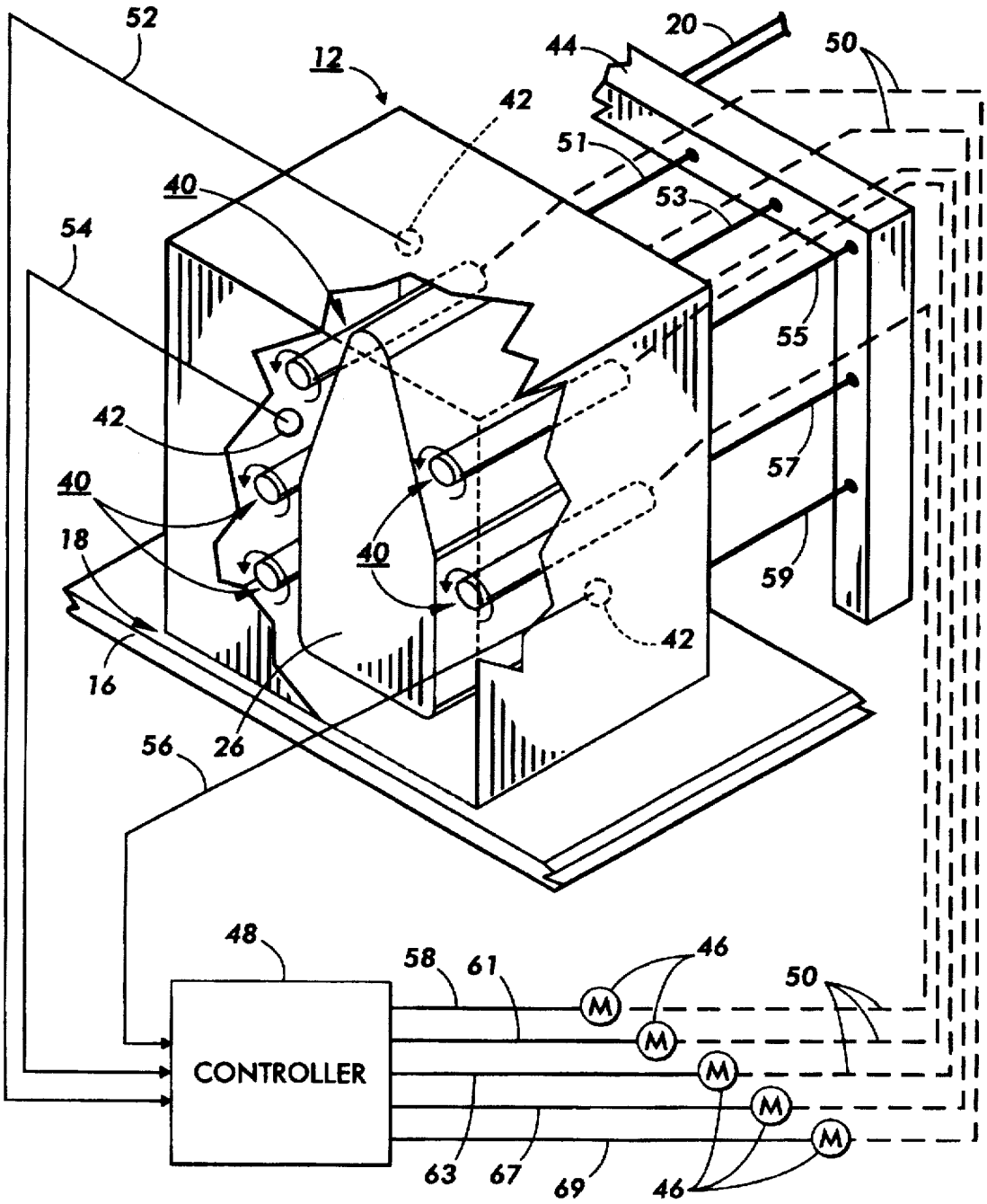
FIG. 4 is a schematic perspective view of the pressurized marking module having an array of slotted air flow tubes therein to control airflow.

FIG. 4 illustrates another embodiment of the present invention wherein air is dispersed by a plurality of air flow tubes having apertures therein. Further detail relevant to the structure of the air tubes will be discussed hereinafter with reference to FIGS. 5 and 6. With continued reference to FIG. 4, photoreceptor 26 is located in an interior chamber of substantially air tight enclosure 12 above sheet path 16. Air flow tubes 40 are positioned adjacent to those areas of photoreceptor 26 which are susceptible to heat and particle contamination. One skilled in the art will appreciate that these areas are influenced by other components which are not shown in the figure. Air flow tubes 40 are rotatable so as to vary the flow of air through the apertures for distribution to hot spots or accumulations of particulate matter. Each air flow tube 40 is connected to a companion drive motor 46 via a coupling 50, wherein there are separate drive motors 46 for each air flow tube 40. The air flow tubes 40 are also connected to a manifold 44 through outlets 51, 53, 55, 57, and 59 which join air input conduit 20 to the respective tube. A plurality of sensors 42 are mounted inside enclosure 12 adjacent air flow tubes 40 for determining the presence of moving air in and around the components. The amount of moving air detected by sensors 42 is transmitted as an electrical signal to a controller 48 via conductors 52, 54, and 56. Controller 48, in turn, processes each feed back signal and correspondingly makes a responsive adjustment at the appropriate drive motor 46 via conductors 58, 61, 63, 67, and 69 to control air flow output at locations adjacent to each tube.

Figure 5:
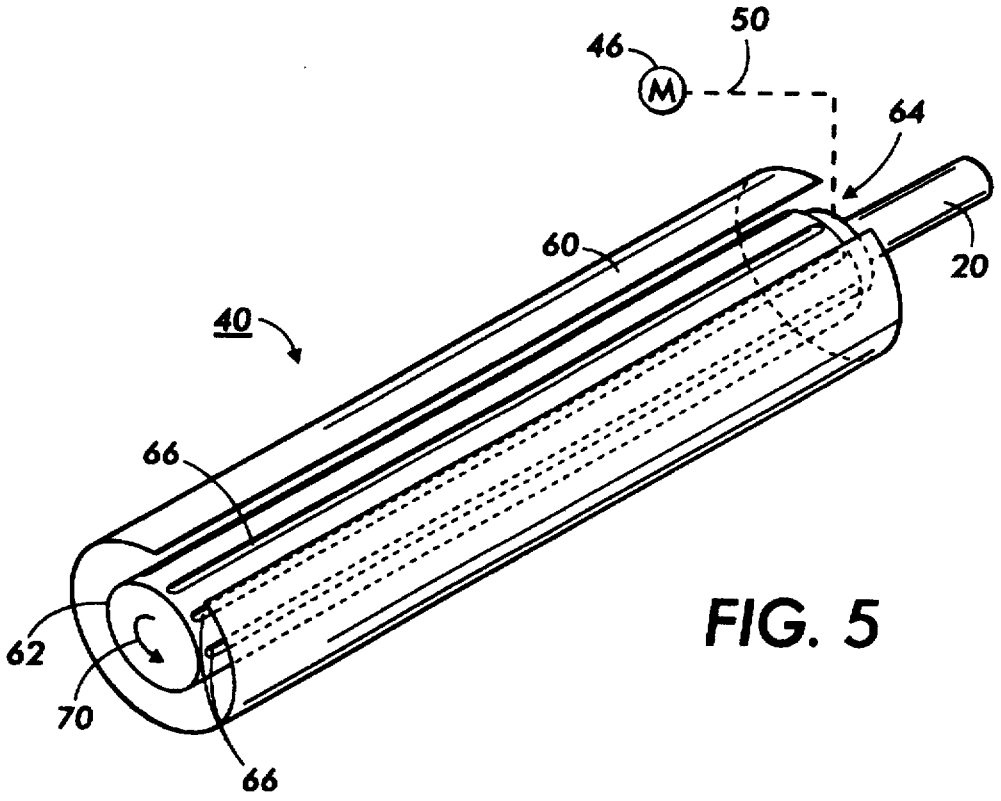
FIG. 5 is a schematic perspective view of a slotted air flow tube having a stationary internal tube enclosed by a rotating tube cover.

Turning now to FIG. 5 there is shown an air flow tube 40 having an internal tube 62 enclosed by a coaxial tube cover 60. The tube may be used with the system hereinbefore discussed with reference to FIG. 4. As shown in FIG. 5, the internal tube 62 has a plurality of apertures 66 therein which form exit ports for air received from the input tube 20 attached thereto. Although apertures 66 are illustrated as slots, one skilled in the art will appreciate that apertures 66 may be comprised of a plurality of holes. The internal tube 62 is rotatably driven, as indicated by arrow 70, by drive motor 46 connected via coupling 50. While tube 62 rotates about an axis, the tube cover 60 having a lengthwise slot 64 therein remains stationary so as to redirect the air flow to areas having hot spots or contamination from an accumulation of particulate matter.

Figure 6:
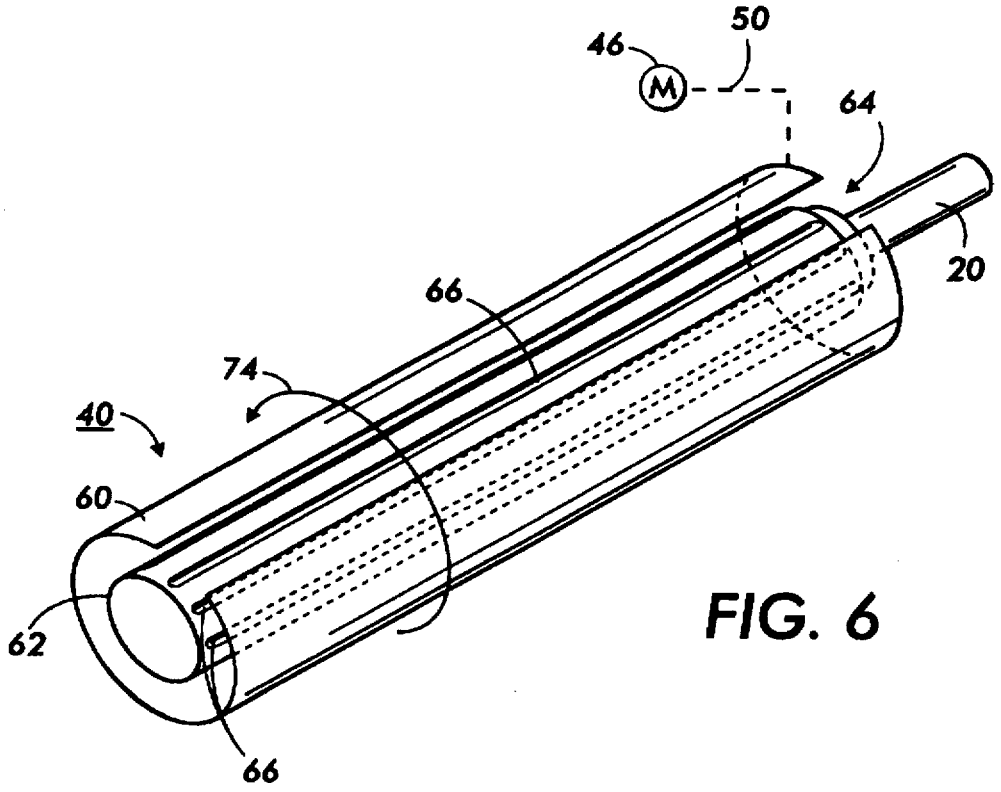
FIG. 6 is a schematic perspective view of a slotted air flow tube having a rotating internal tube enclosed by a stationary tube cover.

In FIG. 6 there is shown an alternative form of air flow tube 40. Internal tube 62 has a plurality of apertures 66 therein which form exit ports for air received from the input tube 20 attached thereto, while tube cover 60 contains a single lengthwise slot 64. Again, one skilled in the art will appreciate that apertures 66 may be comprised of a plurality of holes. Tube cover 60 is rotatably driven, as indicated by arrow 74, by drive motor 46 via coupling 50. Tube cover 60 rotates to redirect the air flow from the stationary internal tube 62 to areas having hot spots or contamination from an accumulation of particulate matter.

Figure 7:
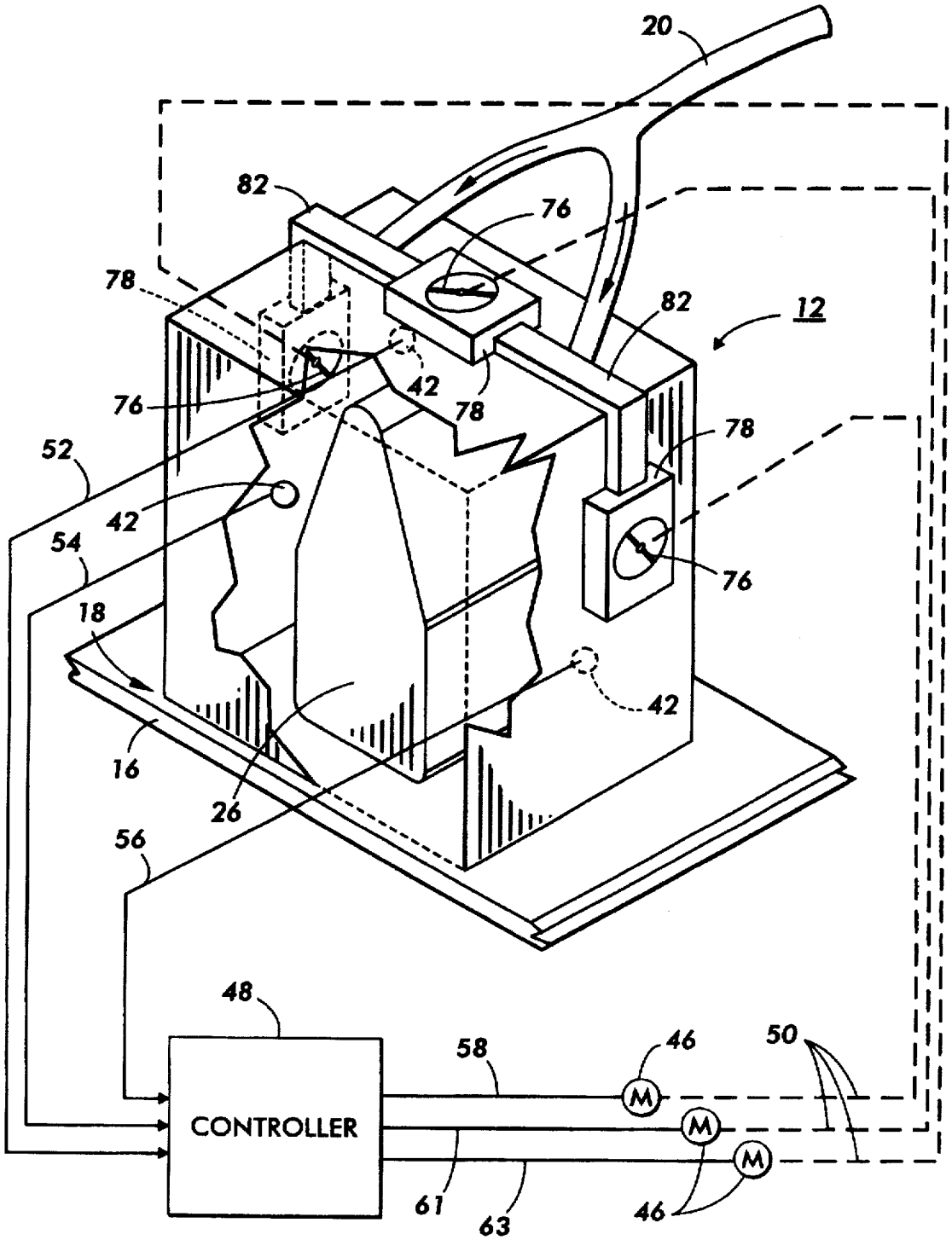
FIG. 7 is a schematic perspective view a of pressurized marking module having diffusers mounted at critical locations to control air flow.

FIG. 7 illustrates yet another embodiment of the present invention wherein air is dispersed by a plurality of diffusers. In FIG. 7, photoreceptor 26 is located in an interior chamber of a substantially air tight enclosure 12 located above sheet path 16. Diffusers 78 are positioned inside or through enclosure 12 and adjacent to those areas of photoreceptor 26 which are susceptible to heat and particle contamination generated by other components, which are not shown. The diffusers 78 are connected to an air duct 82 which is further connected to air input conduit 20. Air entering the diffusers 78 is regulated by companion air valves 76. The air valves perform the function of a damper. Air valves 76 are rotatable so as to vary the flow of air through diffusers 78 for distribution to hot spots or accumulations of particulate matter. Each air valve 76 is connected to a companion drive motor 46 via a coupling 50. A plurality of sensors 42 are mounted inside enclosure 12 close to diffusers 78 for determining the presence of moving air in and around the components. The amount of moving air detected by sensors 42 is transmitted as an electrical signal to a controller 48 via conductors 52, 54, and 56. Controller 48, in turn, processes each feed back signal and correspondingly makes a responsive adjustment at the appropriate drive motor 46 via conductors 58, 61, and 63, to control air flow output at locations adjacent to diffusers 78.

Figure 8:
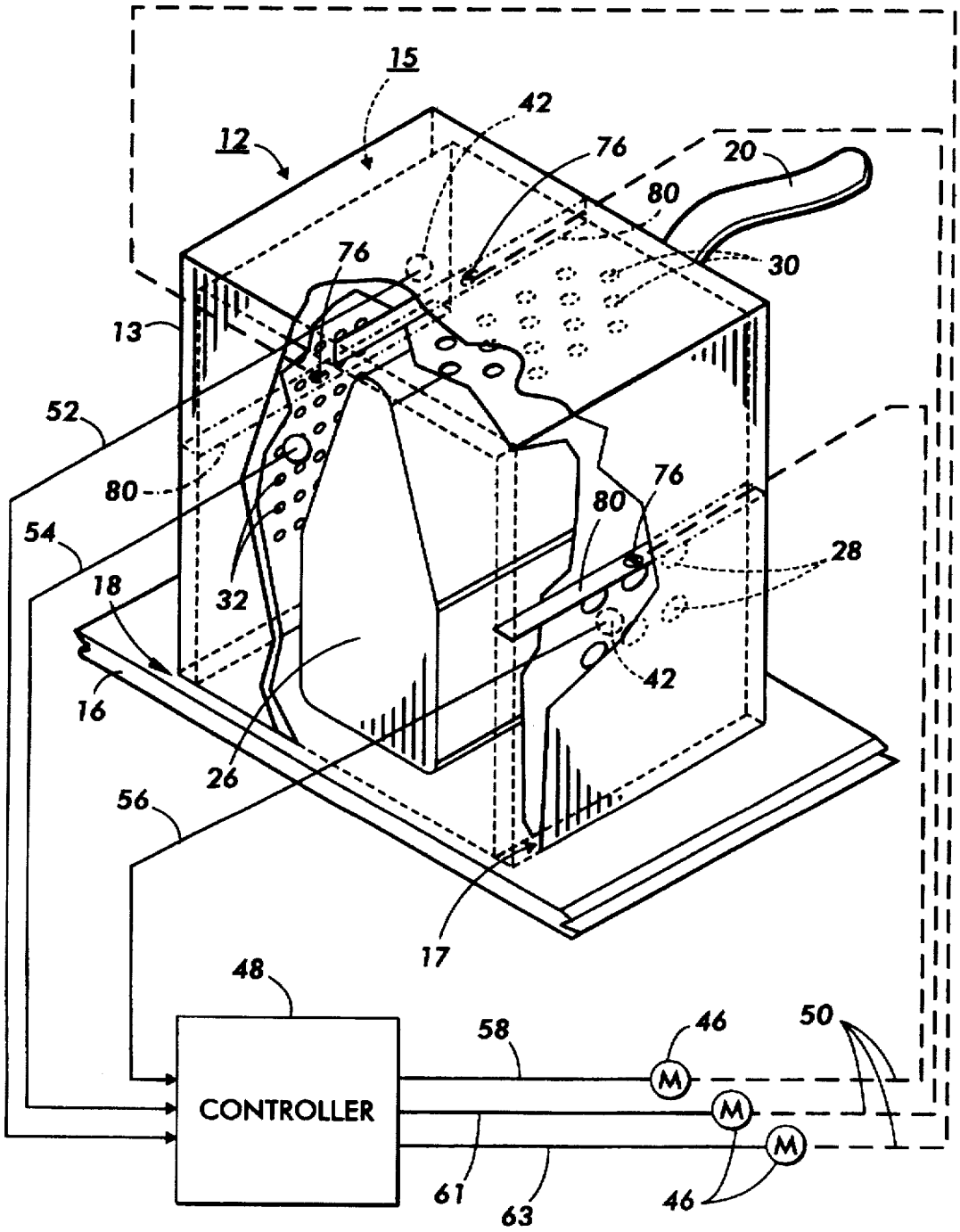
FIG. 8 is a schematic perspective view of a pressurized marking module with an inner wall having apertures defining discrete air flow zones separated by valves located between the air flow source and each of the air flow zones.

FIG. 8 illustrates still another embodiment of the present invention wherein air is dispersed by a plurality of diffusers. In FIG. 8, photoreceptor 26 is located in an interior chamber of a substantially air tight enclosure 12 having an outer wall 13 and an inner wall 15. The inner wall 15 surrounds photoreceptor 26 having other components (not shown) positioned relative thereto. Air is introduced from a remote source (not shown) into passage way 17 formed between walls 13 and 15 via conduit 20. A plurality of apertures 28, 30, and 32 located on inner wall 13 regulate the amount of air flow to critical locations around photoreceptor 26. The size, shape and location of apertures 28, 30, and 32 are determined by air flow requirements. Passage way 17 is further divided into a plurality of zones 80 which are separated by a plurality of air valves 76. The air valves 76 are rotatable and act as dampers to control air flow into each zone and on into the inner wall 15 through apertures 28, 30, and 32 respectively. Each air valve 76 is connected to a companion drive motor 46 via a coupling 50. A plurality of sensors 42 mounted in the inner chamber 15 monitor the presence of moving air in and around the components. The amount of moving air detected by sensors 42 is transmitted as an electrical signal to a controller 48 via conductors 52, 54, and 56. Controller 48, in turn, processes each feed back signal and correspondingly makes a responsive adjustment at the appropriate drive motor 46 via conductors 58, 61, and 63 to control air flow output at critical locations in the inner chamber 15.

In recapitulation, the present invention is directed to controlling air flow within an enclosure housing the marking module of an electrophotographic printing machine so as to produce an even distribution of air thereabout. This reduces hot spots created by component heat losses and toner disturbances.

It is, therefore, evident that there has been provided, in accordance with the present invention, a pressurized and temperature controlled marking module that fully satisfies the aims and advantages of the invention as hereinabove set forth. While the invention has been described in conjunction with preferred embodiments thereof, it is evident that many alternatives, modifications, and variations may be apparent to those skilled in the art. Accordingly, it is intended to embrace all such alternatives, modifications, and variations which are within the spirit and broad scope of the appended claims.

We claim:

1. An apparatus for maintaining an ambient condition about a marking module, including:

a substantially air impervious enclosure defining a chamber having the marking module mounted therein;

an air source, coupled to said enclosure, for supplying air to the chamber;

means for sensing the air flow in the chamber of said enclosure to control the air flowing from said air source to the chamber; and an air dispersion device, coupled to said air source and said sensing means, for controlling the air flow to the chamber of said enclosure, said dispersion device includes a plurality of diffusers, and a plurality of valves coupled to said plurality of diffusers, said valves being responsive to said sensing means for controlling air flow.

2. An apparatus according to claim 1, wherein said dispersion device includes a plurality of air flow tubes, each of said tubes comprising an external tube and an internal tube mounted in said external tube; said internal tubes and said external tubes having apertures therein, said internal tube and said external tube being rotatable relative to each other to vary the air flow through the apertures.

3. An apparatus according to claim 2, wherein each of said internal tubes are stationary.

4. An apparatus according to claim 3, further including means for rotating each of said external tubes.

5. An apparatus according to claim 4, wherein said sensing means senses air flow from each of the internal tubes to control air flow to locations adjacent to the tubes in the chamber of said enclosure.

6. An apparatus according to claim 2, wherein each of said external tubes are stationary.

7. An apparatus according to claim 6, further including means for rotating each of said internal tubes.

8. An apparatus according to claim 7, wherein said sensing means senses air flow from each of the internal tubes to control air flow to locations adjacent to the tubes in the chamber of said enclosure.

9. A printing machine of the type having a printing module associated with non-printing modules, including:

a substantially air impervious enclosure defining a chamber having the printing module mounted therein;

an air source, coupled to said enclosure, for supplying air to the chamber;

means for sensing the air flow in the chamber of said enclosure to control the air flowing from said air source to said chamber;

an air dispersion device, coupled to said air source and said sensing means, for controlling air flow to the chamber of said enclosure, said dispersion device includes a plurality of diffusers, and a plurality of valves coupled to said plurality of diffusers, said valves being responsive to said sensing means for controlling air flow.

10. A printing machine according to claim 9, wherein said dispersion device includes a plurality of air flow tubes, each of said tubes comprising an external tube and an internal tube mounted in said external tube; said internal tubes and said external tubes having apertures therein, said internal tube and said external tube being rotatable relative to each other to vary the air flow through the apertures.

11. A printing machine according to claim 10, wherein each of said internal tubes are stationary.

12. A printing machine according to claim 11, further including means for rotating each of said external tubes.

13. A printing machine according to claim 12, wherein said sensing means senses air flow from each of the internal tubes to control air flow to locations adjacent to the tubes in the chamber of said enclosure.

14. A printing machine according to claim 10, wherein each of said external tubes are stationary.

15. A printing machine according to claim 14, further including means for rotating each of said internal tubes.

16. A printing machine according to claim 15, wherein said sensing means senses air flow from each of the internal tubes to control air flow to locations adjacent to the tubes in the chamber of said enclosure.

* * * * *